US008145076B2

(12) United States Patent
Cornell et al.

(10) Patent No.: US 8,145,076 B2
(45) Date of Patent: Mar. 27, 2012

(54) PRINT SYSTEM WITH DROP-IN INTERCHANGEABLE MODULAR ACCESSORY CARTRIDGE

(75) Inventors: David J. Cornell, Scottsville, NY (US); Joseph A. Manico, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 284 days.

(21) Appl. No.: 12/412,674

(22) Filed: Mar. 27, 2009

(65) Prior Publication Data

US 2010/0247114 A1 Sep. 30, 2010

(51) Int. Cl.
*G03G 15/00* (2006.01)
*G03G 21/00* (2006.01)

(52) U.S. Cl. ..... 399/12; 399/1; 399/110

(58) Field of Classification Search ..... 399/12, 399/13, 1, 2, 107, 110, 24, 48, 101
See application file for complete search history.

(56) References Cited

U.S. PATENT DOCUMENTS

| | | | | |
|---|---|---|---|---|
| 5,105,451 | A | 4/1992 | Lubinsky et al. | 378/28 |
| 5,974,297 | A * | 10/1999 | Creutzmann et al. | 399/384 |
| 6,459,858 | B1 * | 10/2002 | Davis | 399/2 |
| 6,845,219 | B2 * | 1/2005 | Yamamuro et al. | 399/13 |
| 6,885,833 | B2 | 4/2005 | Stelter et al. | 399/48 |
| RE38,957 | E * | 1/2006 | Laussermair et al. | 399/16 |
| 7,063,316 | B2 * | 6/2006 | Graef et al. | 399/110 X |
| 7,899,355 | B2 * | 3/2011 | Sakuma | 399/101 |
| 2003/0016960 | A1 * | 1/2003 | Stelter et al. | 399/49 |
| 2007/0003302 | A1 * | 1/2007 | Mizes | 399/49 |
| 2008/0003002 | A1 * | 1/2008 | Julien | 399/49 |
| 2009/0290902 | A1 * | 11/2009 | Amico et al. | 399/107 |

* cited by examiner

*Primary Examiner* — Sophia S Chen
(74) *Attorney, Agent, or Firm* — Donna P. Suchy

(57) ABSTRACT

A print system with one or more interchangeable modular accessory cartridges that will interchange with conventional printer cartridges. The interchangeable modular accessory cartridges are mounted in the printer in fixed relation to an imaging area and are identifiable to carry out supplemental actions. The accessory cartridges are capable of communicating and are controllable by a controller.

25 Claims, 8 Drawing Sheets

PRINT SYSTEM WITH DROP-IN INTERCHANGEABLE MODULAR ACCESSORY CARTRIDGE

FIELD OF THE INVENTION

The invention relates to a print system and more particularly relates to a print system including one or more interchangeable modular accessory cartridges being operative to communicate. The print system can identify the interchangeable modular accessory cartridge and carry out supplemental actions.

BACKGROUND OF THE INVENTION

Document print systems with scanners have become a popular computing accessory both in the home and the office. Print systems vary in speed, function, and cost and are often used by businesses for printing large quantities of a multitude of documents. The demand for printing with a variety of additional functions in a single box is something that has been difficult to supply in printers, especially in the smaller printers.

New applications for small to mid-volume printers and multi-function printers (MFP's) include the production marketing collateral such as brochures, pamphlets, business cards, sell sheets, signage, and the like. In addition these devices are increasing used to produce high quality images and graphics for personal and professional applications such as portfolios, academic presentations, photo albums, stickers, labels, and photo quality prints. These diverse applications require the use of various receiver substrates with a range of surface characteristics, thicknesses, weights, paper and plastic supports. With some of these medias additional or ancillary fusing capabilities are required, such as pre-fusing or sintering, impulse fusing, or lead edge fusing for borderless printing applications.

It is also desirable to add additional finishing and marking options that can be easily incorporated into a printing system. New requirements include spot and flood gloss capabilities, customizable surface textures, the addition of extended gamut toners, metallic toners, clear toners, magnetic toners, adhesives, and alternative marking technologies.

Furthermore, as print quality requirements increase additional means to monitor and maintain the printer performance is also required. Additional devices and systems to perform Quality Control functions such as densitometers, electrometer, cameras, or sensors to measure toner deposition amounts and locations on the photoconductor web or on unfused prints.

What is needed is simple method to quickly modify the printer to enhance or specialize its functions and capabilities without requiring a service call or a skilled operator and without compromising the original functionality of the printer. Also the interchangeable modules are inclusive of the physical, mechanical, and electrical requirements of a conventional toner cartridge.

It is desirable to have a print system and related methods of printing that can do even more in a small space.

SUMMARY OF THE INVENTION

The invention, in broader aspects, provides a printer and one or more print mechanisms. The printer includes in an accessory area corresponds to an area around said print mechanism and one or more interchangeable modular accessory cartridges that will interchange with conventional printer cartridges. The accessory cartridges are capable of communicating. The interchangeable modular accessory cartridges are mounted in the printer in fixed position relation to the imaging area and carry out supplemental actions.

BRIEF DESCRIPTION OF THE DRAWINGS

The invention and its objects and advantages will become apparent upon reading the following detailed description and upon reference to the drawings.

DETAILED DESCRIPTION OF THE INVENTION

Figure 1:
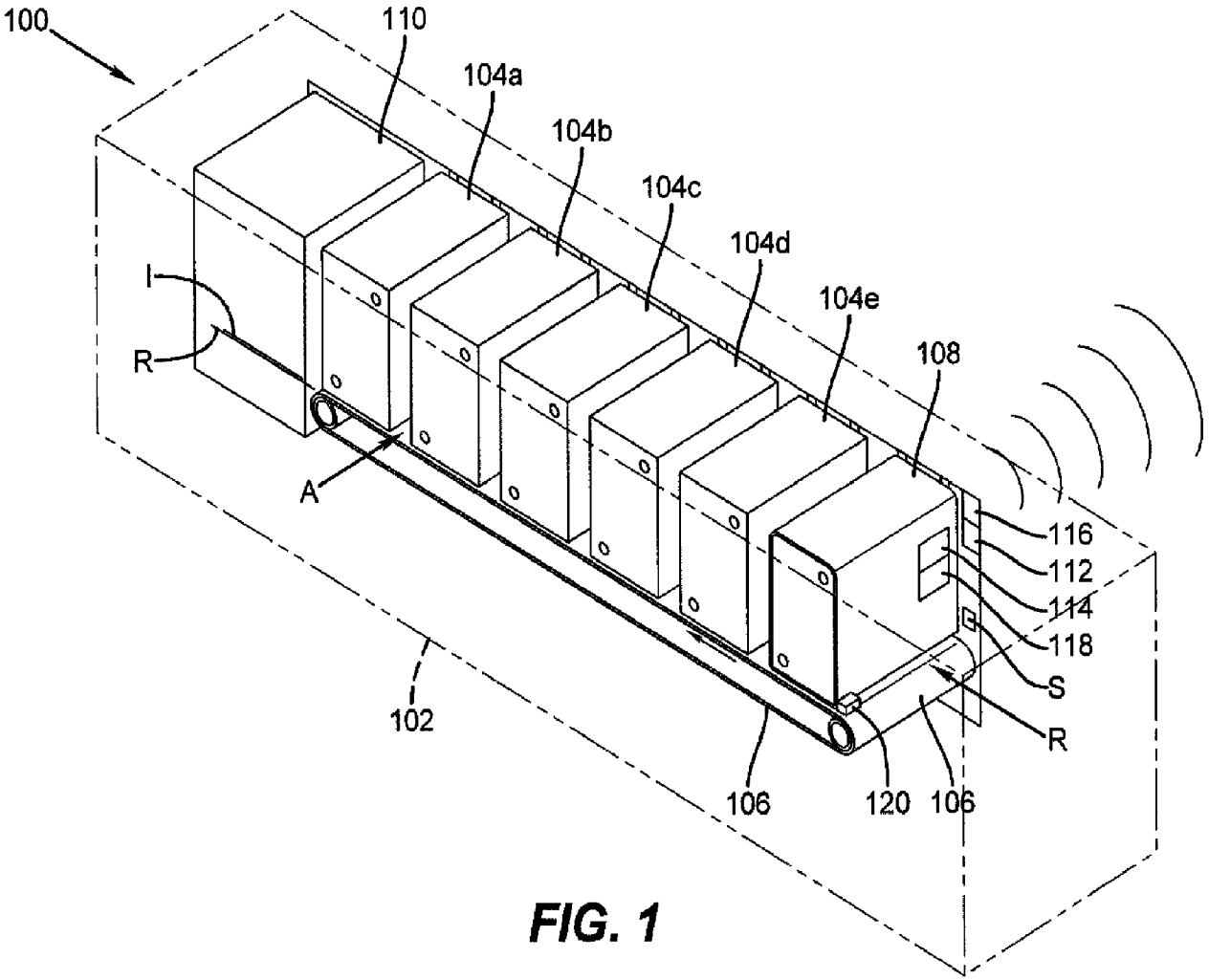
FIG. 1 is a perspective view of a print system having an accessory system.

FIG. 1 shows a printer with accessory system 100. The printer has a body 102 that supports one or more print engines 104 *a-e* that are located relative to a print area A that corresponds to an area around the print engines relative to a transport mechanism, shown here as a transport belt 106, disposed in said body 102 relative to the print area. The transport mechanism could also be a cylinder or other body capable of transporting a receiver R or image I as is known by those skilled in the art. The print engine 104 is disposed in the body in operative relation to the transport mechanism 106 and the print area A. The printer with accessory system 100 also includes one or more interchangeable modular accessory cartridges 108 held by the body 102 that are capable of communicating with the printer engines, transport belt other mechanisms, well as external devices. The interchangeable modular accessory cartridges 108 are shown in FIG. 1 disposed in the body 102 facing respective portions the print area A such that the interchangeable modular accessory cartridge is capable of selectively performing an action related to the printer that does not involve actions performed by the print engine. The printer with accessory system 100 also contains subsystems for fusing the image 110 and for communicating to a host computer via a communication device or module in conjunction with hardware and firmware 112 for processing and transmitting the accessory related informally as well as any additional necessary controllers.

The print engine records images on the receiver using a variety of known technologies including conventional four color offset separation printing or other contact printing, silk screening, dry electrophotography such as is used in the NexPress 2100 printer sold by Eastman Kodak Company, Rochester, N.Y., USA, thermal printing technology, drop on demand ink jet technology and continuous inkjet technology. For the purpose of the following discussions, print engine will be described as being of a type that generates color images. However, this is not necessary and the claimed methods and apparatuses can be practiced with a print engine that is adapted to form monotone images such as black and white, grayscale or sepia toned images.

The modular accessory cartridge has a accessory cartridge controller 114 to identify an accessory cartridge type and control the accessory cartridge in relation to predetermined instructions by using a control signal for initiating operation of the accessory cartridge in relation to the instructions including using the controller to operate the printing system interchangeable modular accessory cartridges in the printer with accessory system 100.

The system 100 also has a printer controller 116, which can incorporate the accessory cartridge controller 114 or be a separate controller. A communication module 118 mounted in the cartridge or mounted relative to the cartridge on the body is also controlled by the accessory cartridge controller 114 and/or the printer controller. The communication module can communicate instantaneous information or information that is collected over time, such as a signal, and can be used to correct problems or control the printer, including the cartridge during printing.

The system 100 also can include memory. Memory includes conventional memory devices including solid state, magnetic, optical or other data storage devices and can be fixed within printer or it can be removable. Data, such as control programs, digital images and metadata, can also be stored in a remote memory. The printer can use the communication module 118 for communicating with, for example, remote memory system. Communication module 118 can be, for example, an optical, radio frequency circuit having a transducer and appropriate signal processing circuitry to convert image and other data into a form that can be conveyed to a remote device such as remote memory system by way of an optical signal, radio frequency signal or other form of signal. Communication module 118 can also be used to receive a digital image and other information from a host computer or network and provide information and instructions from signals received thereby.

The interchangeable modular accessory cartridges can be arranged in various configurations to cooperate with the print engines and other printer functions to activate various printer related functions. Each type of interchangeable modular accessory cartridge has an identification indicator (ids) 120 to facilitate the cartridges functionality. The cartridge controller uses a contact, such as through a locating pin, to identify a type of accessory cartridge as a cartridge type and also to control the cartridge type in relation to predetermined instructions to allow the accessory cartridge to perform a non toner deposition operation. Alternatively the cartridge type and/or predetermined instructions can be communicated through a communication device that can communicate wirelessly.

Figure 2:
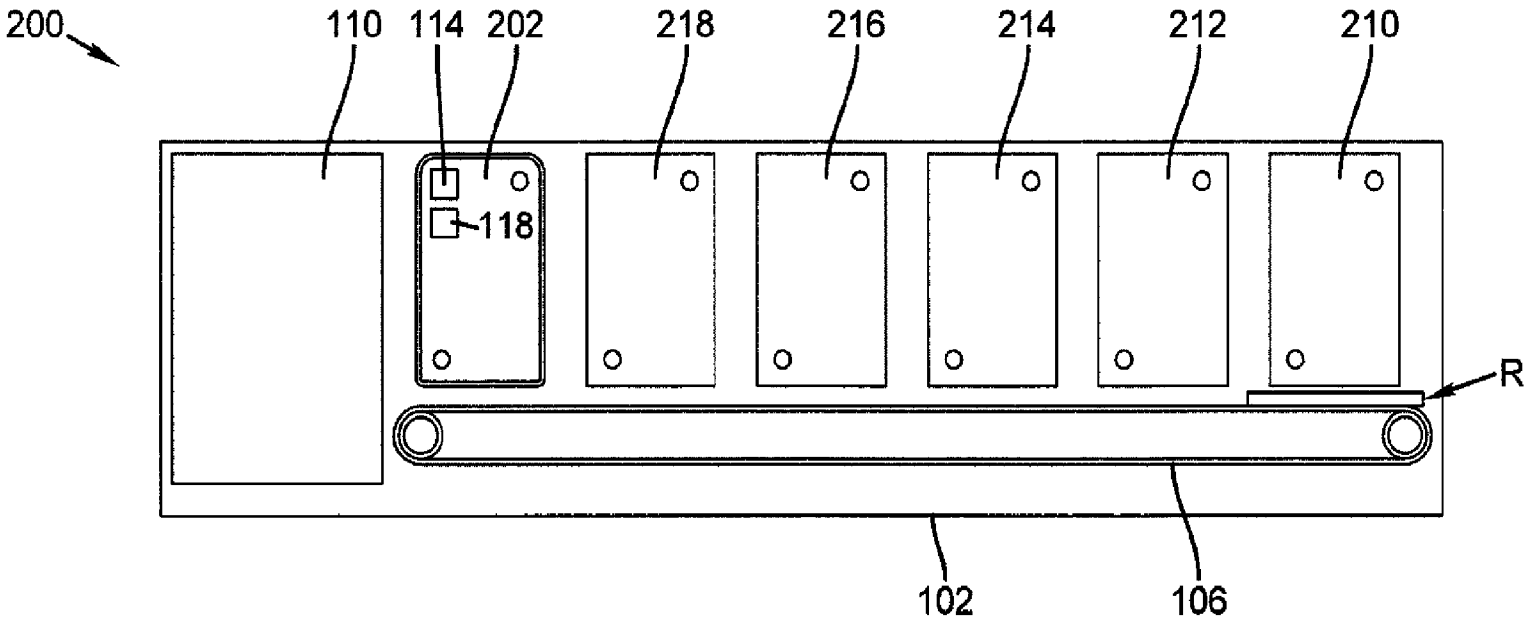
FIG. 2 is aside view of a print system interchangeable modular accessory cartridges system according to the present invention.

FIG. 2 shows one embodiment of a printer with accessory system 200 that has one interchangeable modular accessory cartridges 202 that is mounted so that it follows the print media entrance where a transport belt 106 moves the media, also referred to as receiver R, to a area A around each print engine 210, 212, 214, 216, and 218. The interchangeable modular accessory cartridge 202 in this embodiment includes a postage meter that faces the receiver as it passes and is capable of weighing the postage, stamping it with the appropriate postage as obtained from the controller and/or communication module 118 in communication with the source of that information and finally tri-folding the receiver if desired. The controller 114 is responsive to a control signal and instructions, such as user or controller generated instructions for initiating operation of the interchangeable modular accessory cartridge 202.

Some other types of modules accessory cartridges include print mechanisms that can communicate with remote receivers for communications that aide the user, such as on-line help for a service related module. The modular accessory cartridge 202 can also include, but not be limited to, metering assemblies such as a postal meter with a writer and reader and optional trifold assembly for the paper. Another embodiment includes a magnetic head strip reader for any paper, in conjunction with a scanner and/or bar code reader. Other cartridges 202 could also include various print quality enhancing cartridges such as an accessory cartridge that includes one or more sensors and can create a histograms for one or more sensed condition.

Another embodiment of the modular accessory cartridge includes a cleaner cartridge including a vacuum, brush, wet or electrostatic cleaner, conditioner cartridges, calibration cartridges, and adhesive applicators. The cleaner cartridge in one embodiment includes a solvent imbibed lint-less roller and/or brush to clean a photoconductor belt. The modular accessory cartridge both cleans and informs the print controller 116 to interrupt the printing process during the cleaning process with the help of a timer, sensor and/or stored date such as a table and/or histogram of past cleanings. The interchangeable modular accessory cartridge that includes one or more cleaners can both detect a build up of dust, debris, escaped toner particles, paper fibers, and the like and clean it using such systems as a vacuum, brush, wet or electrostatic cleaner, and or conditioners. This process can be enhanced by comparing the prints to reference images and noting the changes in environmental conditions to suggest maintenance procedures or recovery corrective actions. For example, if a rapid build up of yellow toner is observed the system would alert the user through the communication diode, to check and verify that the yellow toner cartridge is properly seated. If a build up of paper fibers and dust is detected the system would request that the user vacuum out the unit and clean the drive rollers with isopropyl alcohol.

Another embodiment of the modular accessory cartridge can incorporate other print related mechanisms with the non print related portions of the cartridge. These include toning stations and densitometers. In addition the modular accessory cartridge can include one or more sensors including media-type sensors, and media format sensors, such as a media detector sensor, which determines the type of media placed in the printer. The modular accessory cartridge can include only a media sensor alone or in combination with a pre fuser such that the pre-fuser is activated based on the media type along with related characteristics, such as water content and finish. One embodiment of a media determining system and related method involves sensing the dimensions of a receiver sheet including the width and using a paper identifier in conjunction with stored information, such as in a table, to determine the paper's characteristics, including weight. This can be then used in conjunction with other information to instruct the pre-fuser how long and at what temperatures to pre-fuse the image. The cartridge can also sense various environmental factors such as temperature, humidity and other factors that effect the fusing of toner on different paper types and use these to determine prefusing requirements.

The media detector sensor can be used in conjunction to a user input panel, wherein the user indicates the media type being used by entry of a code corresponding to the media type, or selection from a list of media. The media detector can be a visually discerning device capable of finding and interpreting a marking on the medium, for example, a bar code reader, UV detector, or scanner. The medium can have an indicator of media type in the form of human readable markings, a bar code, a UV ink mark, a watermark, or any other form of indicia. The media detector sensor can be a measuring device, capable of determining the media thickness, beam strength, or stiffness of the media. Also the media detector sensor can sense a thickness of the media based on measurement of the height of the media in a paper tray, divided by the number of sheets in the tray. The number of sheets in the tray can be a number entered by a user, or the printer can cycle through the paper to count the sheets, returning counted sheets to the same or a different paper tray.

The information gained by the media detector sensor is provided to the print system 100 to determine if the media is capable of sustaining certain types of printing, such as borderless printing. In addition to the information on media type, if known, the desired gloss level of the final print product can be provided to the print controller. The gloss level can be provided as part of the print data, or can be selected by the user from a menu on the printer user interface. The system can include a look-up table, a logic table, or other format of pre-set conditions that enable determination of whether borderless printing can be done without an image defect.

Other system attributes necessary to complete operational conditions and appropriate responses can be determined by the printer, pre-programmed into the printer, or entered by the user, and used by the system in deciding whether a print can be made. These can include printer specifications, toner specifications, media specifications, and ambient conditions. For example, printer specifications can include printer transport speed, fuser area nip width, fuser area nip exit angle, whether and what type of coating is on the fuser apparatus where it can contact the toner-bearing side of the media, compliance of the fuser apparatus on a side not adjacent to the toner on the media. Toner attributes can include melting point temperature and glass transition point temperature. Media attributes can include media composition, density, and moisture content. Ambient conditions can be determined by one or more printer sensor, entered by the user, or determined by remote apparatus and relayed to the printer, and can include relative humidity, temperature, and barometric pressure.

Determination of whether a print will be successful in one embodiment can be done based on the beam strength of the media, weight of the media, the desired gloss level, or any one or more of the other system attributes, alone or in combination. To enable borderless printing for example, the media can have a beam strength or stiffness of about 600-800 mN or greater. Media suitable for borderless printing can have a weight of 250 gsm (grams per square meter) or higher, referred to herein as "heavy media." Typically, such heavy media does not experience image defects in borderless printing. If the media weight is less than 250 gsm ("light media"), there is a greater probability that borderless printing will create a defect in the first few millimeters of the print. Thus, light media, having a weight of less than 250 gsm, is not desirable for borderless printing. Adding a gloss finish, regardless of level, matte, semi-gloss, or high gloss, will cause a light media to stick to the apparatus in the fuser area, creating image defects. Any type of media with a toner load at or near the leading edge, whether from a clear coat, text, or image, can cause sticking in the fusing area due to the height of the applied toner.

Figure 3:
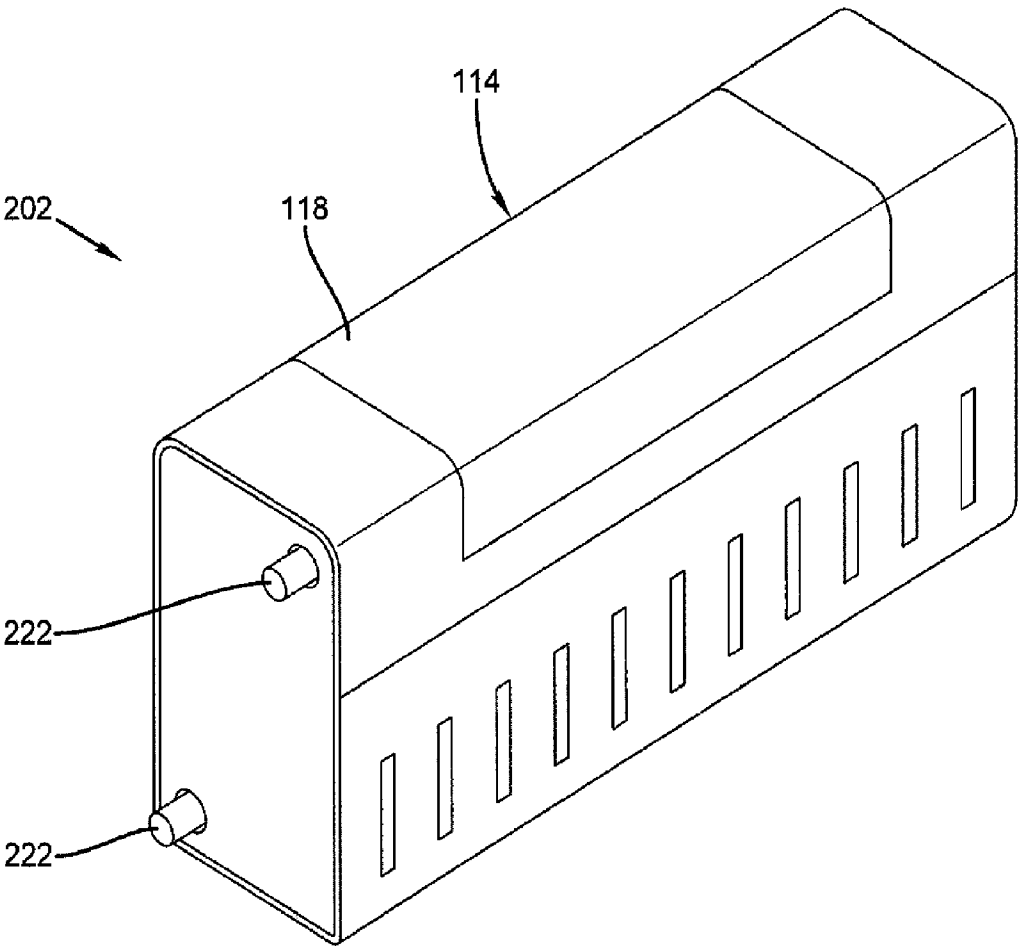
FIG. 3 shows detail of the accessory cartridge system with according to the present invention.

FIG. 3 shows a close up of the interchangeable modular accessory cartridge 202 including the communication module 118 and pins 222 to help align interchangeable modular accessory cartridge 202 in the correct location in the printer 100. These pins can include communication devices, controllers and switches as well as other indicators to work in conjunction with the parts of the printer, such as the printing engines and fuser, as well as with the controller (not shown in FIG. 3, which can be incorporated with the printer controller 116 and the communication module 118 and other specialized parts of the interchangeable modular accessory cartridge 202 such as the postage meter described above.

Figure 4:
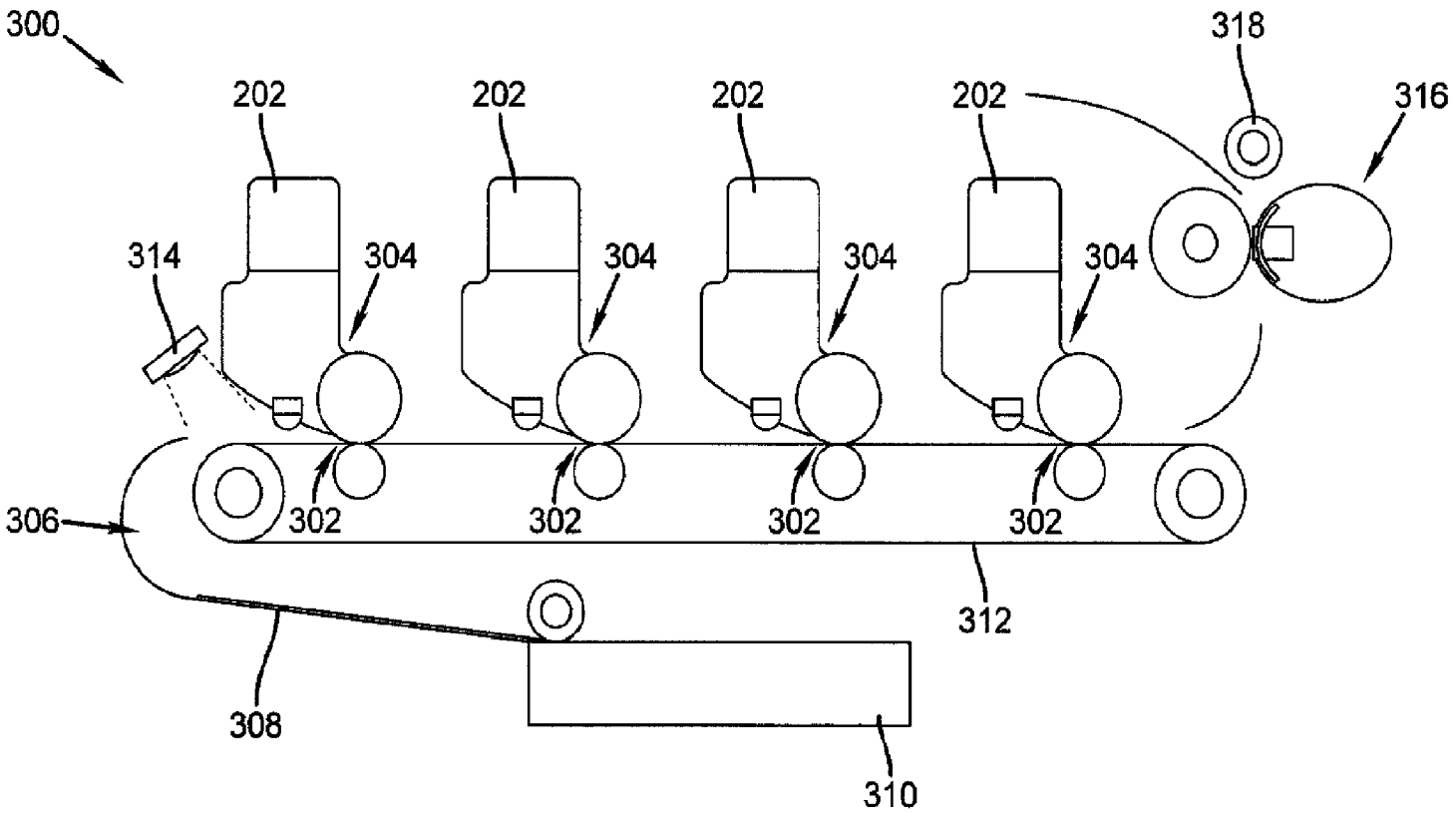
FIG. 4 is a schematic side view, showing details of the interchangeable modular accessory cartridges mechanisms of the accessory system.

FIG. 4 shows additional details of another embodiment of a printer accessory system 300 including four spaces 302 with interchangeable modular accessory cartridges 202, each having a printing station 304 with a toner system, including a toner supply and mixing device, facing the paper path 306 that supplies receivers 308, also referred to as media, from a media supply 310 to the transport belt 312. The transport belt transports the receiver 308 past the one or more imaging systems 314 to a fusing system 316 past one or more rollers 318, including an exit roller. Any of these four spaces can be interchanged with the interchangeable modular accessory cartridges 202 discussed above.

A modular accessory cartridge that includes one or more cameras is used to detect defects and other print related problems and/or activities such as a web defect. The interchangeable modular accessory cartridges 202 shown in FIG. 4 also include one or more cameras such as described in patent applications U.S. Ser. No. 12/015,155 filed on Jan. 16, 2008 and U.S. Ser. No. 12/022,360 filed on Jan. 30, 2008 that are hereby incorporated by reference. The camera can view in the visible spectrum or be a specialized camera that may use filters, such as polarizing or wavelength specific filter, and other optical related devices that are known in the art. In one embodiment the camera includes an infrared (IR) sensitive sensor to capture invisible or near invisible infrared illumination can be used internally in the printing device to detect localized heat patterns that are not visible with conventional visible light sensitive sensor. The camera can also detect a paper jam and other visual indications of problems that would affect printing. For example if the interchangeable module cartridge with a camera is located at the near the paper feeder then the cartridge could detect a paper jam and misalignment problems. The interchangeable module cartridge can generate at least one and preferably a stream of images from the camera and communicate them using, for example, an error signal responsive to the media jam. Another unit can receive the streams of images from the cartridge and respond to the error signal and generates a log including one of more current images from the one or more streams and /or all streams.

The printer control unit 116, also referred to as the controller, controls the portions of the system 100 and can include a microprocessor, micro-controller, or any other electronic circuit adapted to govern image scanning, processing, storage and accessory sharing processes. The printer system 100 could include one or more sensors S to collect information to pass to the control unit 116, also referred to as a controller including a central processing unit, which can be part of a computer or other device. The captured information may be stored, transmitted and/or manipulated as desired. Typically, the captured accessory information, including images, would be sent to a device for writing the information on to a storage medium for example, a CD or computer disk and the non-archival will be sent to the viewer. Alternatively, the data could be sent to an image storage device, which could be the computer of the owner of the images, a printer for printing of the image, or simply to a long term or temporary storage device or facility. The control unit can include image processing. Having the image processing built into the printer with accessory system, as opposed to having the host computer do the image processing, allows for use of dedicated electronic hardware for this function, providing faster processing speeds. The image processing could include, but is not limited to, image enhancements, conversion to a grayscale or a black-and-white image, image skew correction, border removal, background form dropout, and image file compression.

Another embodiment of the modular accessory cartridge includes other printing devices such as one or more inkjet linear or cartridge heads or plate or roller type printer. These additional heads could be used to apply an ink or powder for various purposes, such as a base coat or overcoat. The controller discussed above can include a processor to perform a number of pre-printing or post-printing operations using the interchangeable modular cartridge, including pre-printing operations such as applying a base coat. Once the preprinting operations are complete, control unit can cause print engine to print on the base. These pre and post-printing modules can include any form of printing known in the art, such as inkjet.

Figure 5:
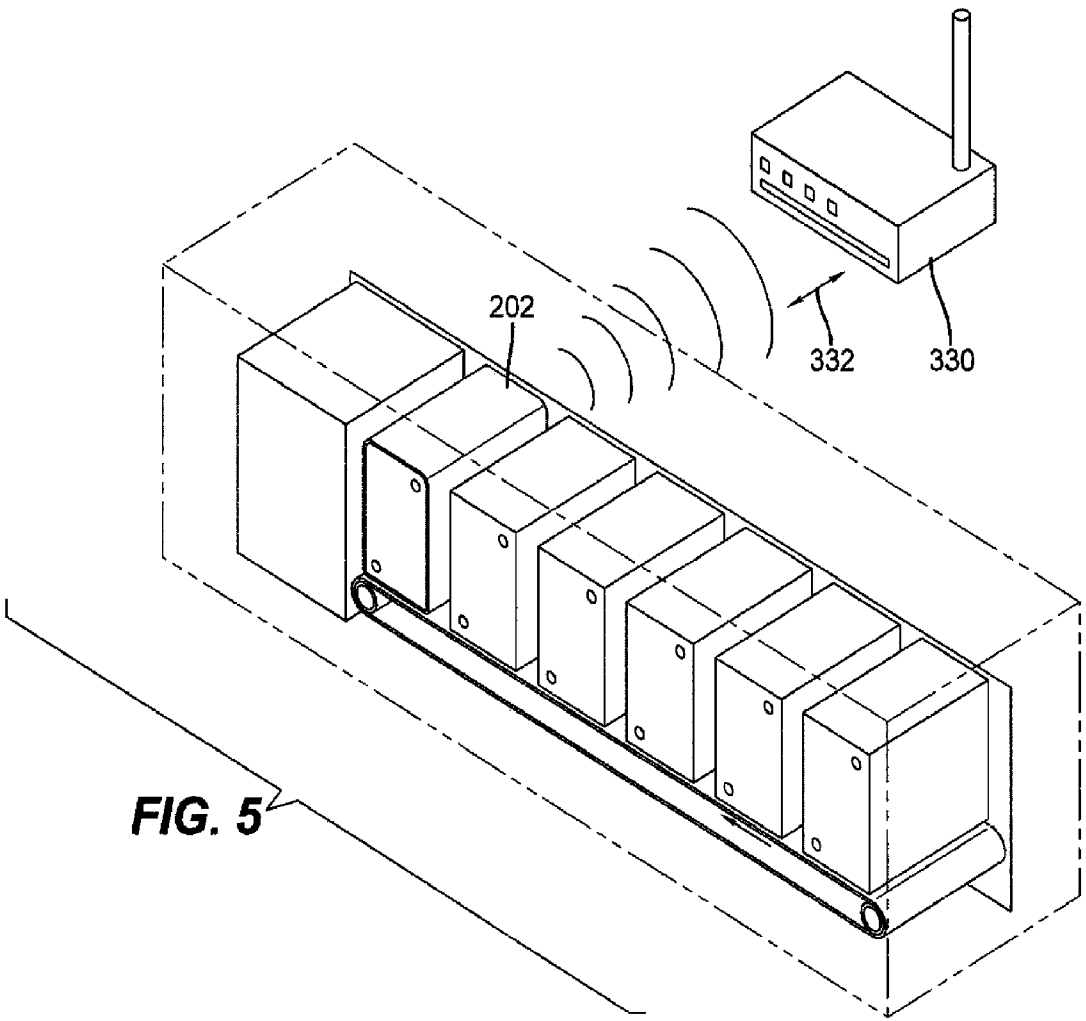
FIG. 5 shows the accessory system in communication with another device.

FIG. 5 shows one interchangeable modular accessory cartridge 202 in communication with a remote controller 330 that can transmit relevant data about the printer. The interchangeable modular accessory cartridge 202 is responsive to a control signal 332 and instructions, such as user or controller generated instructions via the controller 330 for initiating operation of the one interchangeable modular accessory cartridge 202 and inversely can receive data 332 from the one interchangeable modular accessory cartridge 202 to transmit to a user or other printer such as the printing system sending resultant instructions.

Figure 6A:
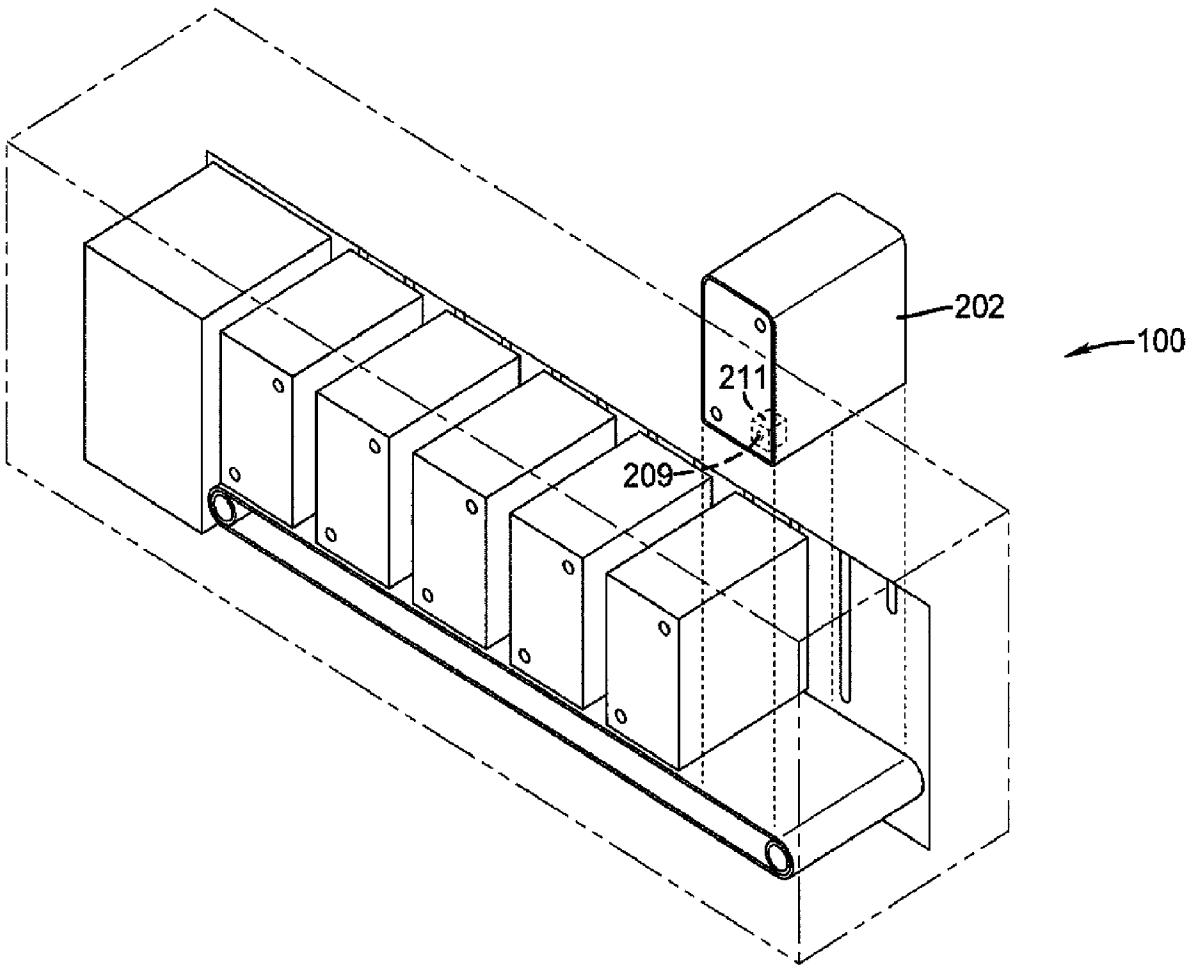
FIGS. 6A and 6B are embodiments of the accessory system.
Figure 6B:
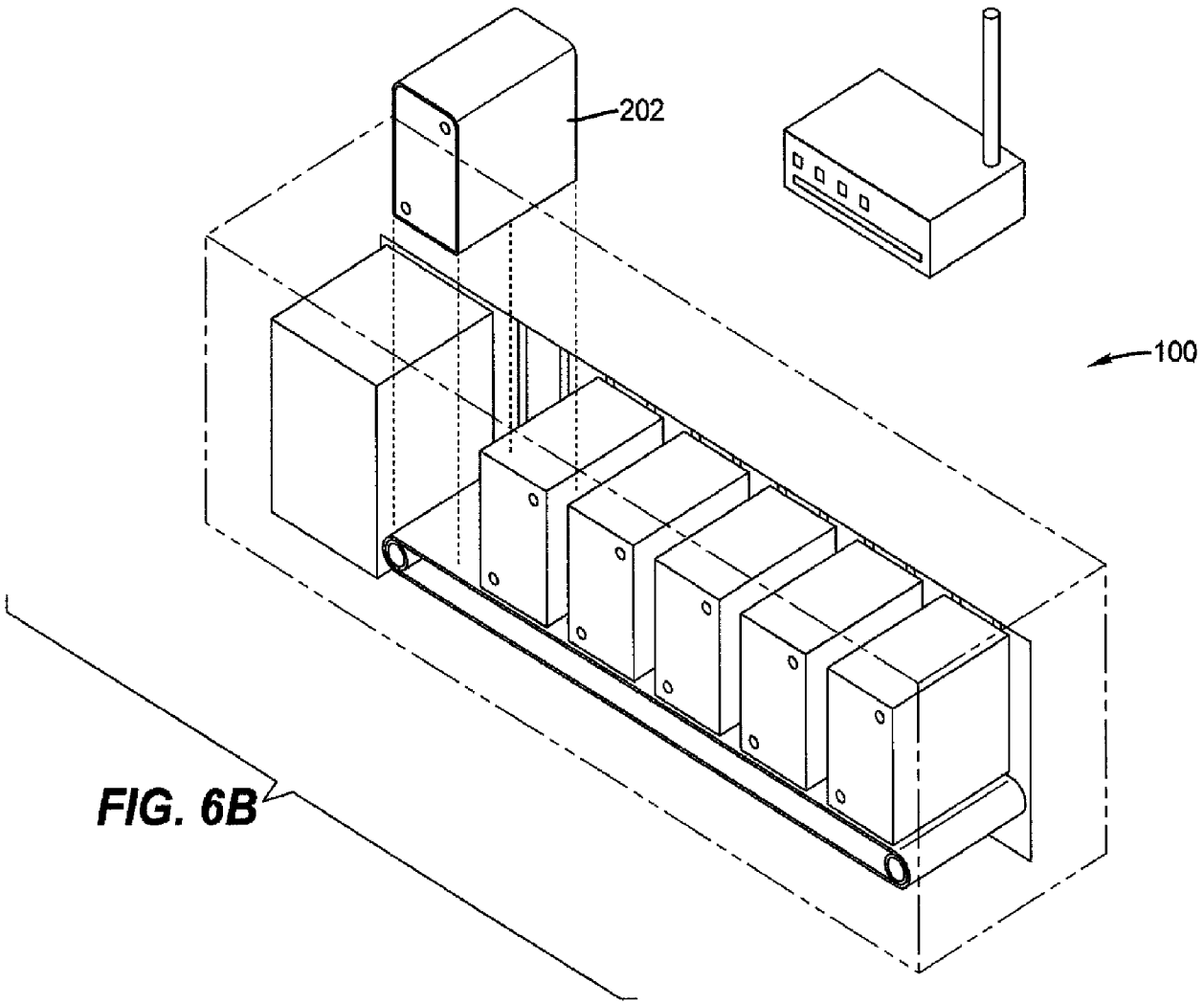
Figure 7:
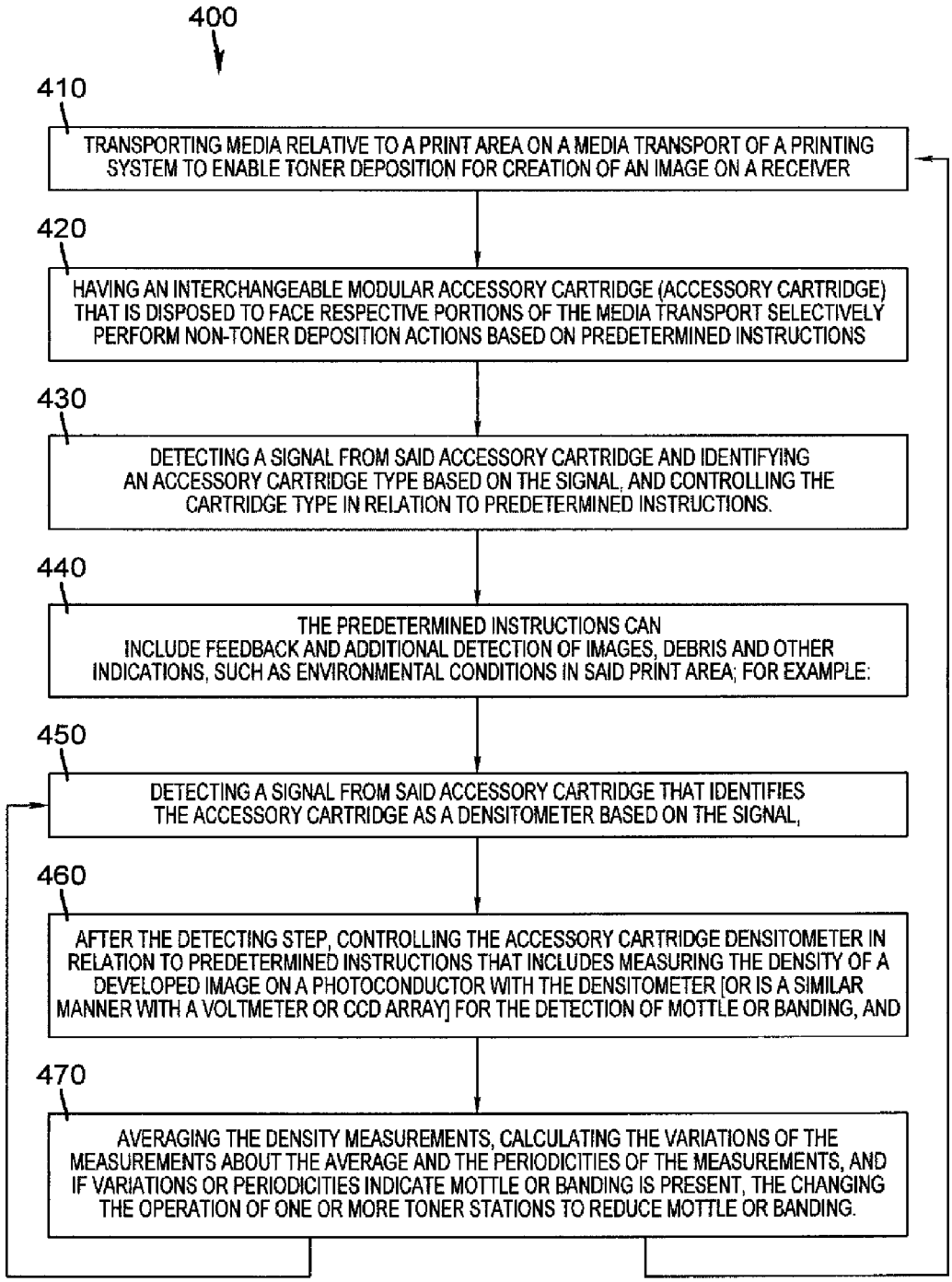
FIG. 7 shows the steps for a method of using the print system with accessory system.

FIGS. 6A and 6B show the use of the interchangeable modular accessory cartridge 202 in the first position and the last position of a printer. These accessory cartridges include one or more of an encryption device, communication device and authorization device and related software, a postage meter system authorization and metering, a ticket supply system includes authorization software and a payment system, one or more cleaning devices positioned relative to the printing area so that said cleaning device is substantially perpendicular to a media print path for cleaning said path.

A transport mechanism, such as the transport belt 106, moves the receiver sheet R into engagement with a photoconductor in the print engine 104 in register with the image, for transferring the image to receiver R. Alternatively, the image may be transferred to an intermediate member, and then from the intermediate member to receiver R. A separate cleaning station removes residual toner from the transport belt 106 to allow reuse of the surface for forming additional images After transfer of the unfixed toner images to receiver sheet R, sheet R is transported to a fuser station where the image is fixed.

In one embodiment, the interchangeable modular accessory cartridge 202 includes a small aperture 209 densitometer 211 that measures the density of a process control patch with the small aperture densitometer to determine both the average density and fluctuations in density that indicate mottle or banding. The small aperture densitometer with an aperture of approximately 1 mm.sup.2 is preferred, since the peak sensitivity of the human eye to noise is at spatial wavelengths of approximately ⅛ inch. In an alternate embodiment, an electrometer with a small aperture and rapid response time is used to measure nonuniformities in the image voltage. The interchangeable modular accessory cartridge 202 is situated as shown in a first position along the paper path. The electrometer spacing from the photoconductor is typically 0.100"+/−0.035". Photodiodes typically used in the small aperture densitometer for this application include PIN silicon photodiodes types OP913SL and OP913WSL having acceptance angles of 10 degrees and 30 degrees respectively from the optical axis. These units can detect very low light levels, a characteristic making them qualified for use in the invention. The use of a pinhole opening to mask the photodiode reduces the photodiode's working acceptance angle, thereby allowing the detection of smaller nonuniformities in toner density as required. In electrometer for this application, electrostatic non-contact voltmeters used include the Trek Model 370 or equivalent, which has a response speed of approximately 50 microseconds and an aperture approximately 2 mm in diameter. Alternately, a CCD array with linearity of frequency response comparable to that of acceptable photodiode detectors is usable for measurement of optical density fluctuations. Density determination using a CCD array is done with image analysis software for spot and band detection and measurement, as is well-known. The aperture and response time of the photodiode, the electrometer, and the CCD array are appropriate for detecting nonuniformities with spatial wavelengths on the order of ⅛ inch or less.

Using the detection inputs, the print controller 116 calculates average density, variation about the average, and periodic variation. Process control adjusts density so that the average density is in an acceptable range. If either mottle or banding or both are present, the print controller 116 directs the increase of toner density by making appropriate increases in E.sub.0, V.sub.B, and V.sub.0. If toner density level is acceptable but banding is present, the print controller 116 increases the magnetic core speed of print engine 104. A detection unit using this invention detects mottle and banding, and distinguishes between them. In a basic embodiment, the invention uses a single densitometer as discussed above, and takes multiple density readings from each test patch as required. The invention operates in this embodiment as follows.

A test patch with mottle and banding respectively is used so that the cartridge detector 202 is actually in a fixed position in the printer, while the transport belt 106 and the test patch on it move. Mottle conditions will cause the cartridge detector 202 to change readings at irregular intervals. Banding conditions will cause the cartridge detector 202 to change readings on a regularly periodic basis. This allows nonuniformities of approximately 2 mm in size to be detected when the transport belt moves at speeds between 80-120 ppm by detecting changes in density of test patch along the direction of travel of the test patch. The cartridge detector 202 takes multiple densitometer readings for each test patch. The cartridge detector 202 counts each significant change in density on a test patch, producing a positive count pulse for each increase and a negative count pulse for each decrease. The cartridge detector 202 records the time intervals between successive pairs of positive count pulses. The cartridge detector 202 sums the positive count pulses in a first sum, and the negative count pulses in a second sum, from all detectors. If the cartridge detector 202 detects counts above a specific threshold for both the first sum and the second sum, it signals a mottle or banding condition. The cartridge detector 202 compares the time intervals between successive pairs of positive count pulses. If time intervals between successive pairs of positive count pulses are approximately equal, the cartridge detector 202 signals a banding condition. If the cartridge detector 202 detects a mottle condition or a banding condition, it directs an increase in toner density via controller 116. If the cartridge detector 202 detects a banding condition, it directs an increase in magnetic core speed via controller 116.

In summary, the cartridge detector 202 compares the intervals between succeeding count pulses from a test patch. If the time interval between a first pair of pulses matches that between a second pair of pulses and that between a third pair of pulses, the regularity of appearance of the pulses implies a banding condition. Pulses appearing irregularly imply a mottle condition. The condition detected drives adjustment of toner density and/or development station core speed as required. In another embodiment, the single detector is replaced by multiple detectors and/or a CCD array or photocells disposed across the test patch in a row perpendicular to the direction of travel. For example if the cartridge detector 202 has two detectors they can be disposed along the same line as desired. If the cartridge detector 202 detects counts above a specific threshold, it signals a mottle or banding condition. If pulses from most or all detectors arrive synchronously, the cartridge detector 202 signals a banding condition. If the cartridge detector 202 detects a mottle condition or a banding condition, it directs an increase in toner density. If the cartridge detector 202 detects a banding condition, it directs an increase in magnetic core speed. This invention allows production of images that have acceptable, low toner stack heights, minimal mottle, and minimal banding. The invention adjusts toner density to address mottle and banding conditions accurately. This accuracy reduces toner consumption by obviating the manual setting of toner density at a too-high level to avoid mottle or banding. From the above descriptions, figures and narratives, the invention's advantages in these respects should be clear.

This accessory module is used in a printing system. One printing method 400 including the steps of transporting media relative to a print area on a media transport of the printing system 410 to enable toner deposition for creation of an image on the receiver so that during said transporting the interchangeable modular accessory cartridge (accessory cartridge) is disposed to face respective portions of said media transport and can selectively perform a non toner deposition action 420. First detecting a signal 430 from said accessory cartridge and, responsive to said signal, identifying a type of accessory cartridge as a cartridge type and controlling the cartridge type in relation to predetermined instructions. The predetermined instructions can include feedback 440 and additional detection of images, debris and other indications, such as environmental conditions in said print area. In one embodiment the detecting includes measuring the density of a developed image on a photoconductor with a densitometer 450, voltmeter or CCD array for the detection of mottle or banding and controlling the cartridge 460 in relation to the measurements 470. One method is to average the density measurements, calculating the variations of the measurements about the average and the periodicities of the measurements, and if variations or periodicities indicate mottle or banding is present, then changing the operation of one or more stations to reduce mottle or banding.

The invention has been described in detail with particular reference to certain preferred embodiments thereof, but it will be understood that variations and modifications can be effected within the spirit and scope of the invention.

What is claimed is:

1. A printing system comprising:

a body;

a transport mechanism disposed in said body relative to a print area;

a print engine disposed in said body having a plurality of spaces in which a print module can be positioned in operative relation to the transport mechanism and a respective portion of a print area;

an interchangeable modular accessory cartridge disposed in one of said spaces facing the respective portion of said print area, said accessory cartridge capable of selectively performing a non toner deposition action portion; and a cartridge controller that is configured to determine when a print module is in one of the spaces and to control the print module for printing and to determine when an modular accessory cartridge is in one of the spaces, to identify a type of accessory cartridge in the space as a cartridge type and to control the cartridge type in relation to predetermined instructions to cause the accessory cartridge to perform a non-toner deposition operation.

2. The apparatus of claim 1 in which said accessory cartridge comprising a processor and output system to send resultant feedback.

3. The apparatus of claim 1 in which said accessory cartridge comprises one or more communication devices and related software.

4. The apparatus of claim 1 in which said accessory cartridge comprises a postage meter and authorization system.

5. The apparatus of claim 1 in which said accessory cartridge comprises ticket supply systems.

6. The apparatus of claim 5, wherein the ticket supply system includes authorization software and a payment system.

7. The apparatus of claim 1 in which said accessory cartridge comprises one or more cleaning devices positioned relative to the printing area so that said cleaning device is substantially perpendicular to a media print path for cleaning said path.

8. The apparatus of claim 1 in which said accessory cartridge comprises one or more paper fold assemblies for the paper.

9. The apparatus of claim 1 in which said accessory cartridge comprises one or more magnetic head strip readers along with a scanner and/or bar code reader.

10. The apparatus of claim 1 in which said accessory cartridge comprises one or more sensors for one or more sensed condition.

11. The apparatus of claim 1 in which said accessory cartridge comprises one or more applicators.

12. The apparatus of claim 1 in which said accessory cartridge comprises one or more cameras that are used for at least one of defect detection and other print related activities.

13. The apparatus of claim 1 in which said accessory cartridge comprises at least one of an inkjet linear head, an ink jet cartridge head, a plate type printer and a roller type printer.

14. The apparatus of claim 1 in which said accessory cartridge comprises one or more densitometers.

15. The apparatus of claim 14 in which said densitometer has an aperture small enough to detect mottle or banding with spatial wavelengths perceptible by human eyes.

16. The apparatus of claim 14 in which said accessory cartridge further comprises a processor which averages density measurements, calculating variations of the measurements about the average and periodicities of the measurements, and if the variations or periodicities indicate mottle or banding is present, then changing the operation of one or more stations to reduce mottle or banding.

17. The apparatus of claim 1 in which said accessory cartridge comprises a voltage meter and a processor which uses voltage measurements to control the photoconductor image, calculating variations of the measurements about the average and periodicities of the measurements, and if the variations or periodicities indicate mottle or banding is present, then changing the operation of one or more stations to reduce mottle or banding.

18. A printing method comprising the steps of:

transporting media relative to a print area on a media transport of a printing system to enable toner deposition for creation of an image on a receiver;

determining when an interchangeable modular accessory cartridge is disposed in one of a plurality of spaces of a print engine in which a print module can be positioned to face a respective portion of said print area along media transport, said accessory cartridge capable of selectively performing a non toner deposition action;

detecting a signal from said accessory cartridge; and responsive to said signal, identifying a type of accessory cartridge as a cartridge type and controlling the cartridge type in relation to predetermined instructions to perform the non toner deposition action in the print area.

19. The method of claim 18 wherein said predetermined instructions comprise feedback.

20. The method of claim 18 wherein said detecting step further comprises detecting in said print area.

21. The method of claim 20 wherein the detecting step comprises a measuring of a density of a developed image on a photoconductor by a densitometer for a detection of mottle or banding.

22. The method of claim 21 further comprising: averaging density measurements, calculating variations of the measurements about the average and periodicities of the measurements, and if variations or periodicities indicate mottle or banding is present, then changing an operation of one or more stations to reduce mottle or banding.

23. A printing system comprising:

a body;

a transport mechanism disposed in said body relative to a print area;

a print engine disposed in said body having a plurality of spaces in which a print module can be positioned in operative relation to the transport mechanism and a respective portion of said print area;

an interchangeable modular accessory comprising a postage meter and authorization system disposed in one of said plurality of spaces facing a respective portion of said print area, said accessory cartridge capable of selectively performing a non toner deposition action in the respective portion; and a cartridge controller that is configured to determine when a print module is in one of the spaces and to control the print module for printing and to determine when an modular accessory cartridge is in one of the spaces, to identify a type of accessory cartridge in the space as a cartridge type and to control the cartridge type in relation to predetermined instructions to cause the accessory cartridge to perform a non toner deposition operation.

24. The apparatus of claim 23 in which said interchangeable modular accessory further comprises one or more magnetic head strip readers along with a scanner and/or bar code reader.

25. The apparatus of claim 23 in which said interchangeable modular accessory further comprises an applicator.

* * * * *